United States Patent [19]

Ploeger, Jr.

[11] 4,113,392

[45] Sep. 12, 1978

[54] PRINTING RIBBON

[75] Inventor: Walter Ploeger, Jr., North Bellmore, N.Y.

[73] Assignee: Filmon Process Corp., Westbury, N.Y.

[21] Appl. No.: 578,581

[22] Filed: May 19, 1975

Related U.S. Application Data

[63] Continuation-in-part of Ser. No. 485,641, Jul. 3, 1974, abandoned.

[51] Int. Cl.[2] ..... B41J 31/02

[52] U.S. Cl. ..... 400/240.1; 400/697

[58] Field of Search ..... 197/91, 151, 172, 181

[56] References Cited

U.S. PATENT DOCUMENTS

| | | | |
|---|---|---|---|
| 1,905,118 | 4/1933 | Nadell | 197/181 |
| 2,255,104 | 9/1941 | Dixon | 197/172 |
| 2,324,662 | 7/1943 | Aaron | 197/172 X |
| 3,114,447 | 12/1963 | Wolowitz | 197/172 |
| 3,141,539 | 7/1964 | Wolowitz | 197/172 |
| 3,143,200 | 8/1964 | Gutman | 197/172 |
| 3,273,686 | 9/1966 | Ploeger | 197/181 X |
| 3,274,039 | 9/1966 | Ploeger | 197/172 X |
| 3,752,291 | 8/1973 | Barouh et al. | 197/172 |
| 3,825,104 | 7/1974 | Wolowitz | 197/172 |

FOREIGN PATENT DOCUMENTS

| | | | |
|---|---|---|---|
| 961,108 | 6/1964 | United Kingdom | 197/172 |

*Primary Examiner*—J. Reed Fisher

*Attorney, Agent, or Firm*—Seidel, Gonda & Goldhammer

[57] ABSTRACT

A printing ribbon is composed of a printing portion and a correction portion welded together and extending parallel to each other. The correction portion lies in the plane of the printing portion which is the thickest portion of the ribbon and constitutes only a single thickness of inked fabric.

6 Claims, 2 Drawing Figures

PRINTING RIBBON

PRIOR FILED APPLICATION

This application is a continuation in part of my copending application Ser. No. 485,641 filed July 3, 1974, now abandoned.

BACKGROUND OF THE DISCLOSURE

A wide variety of printing ribbons having a printing portion and a correction portion have been disclosed in the prior art. For example, see U.S. Pat. Nos. 3,143,200; 3,273,686 and British Pat. No. 961,108. Commercial embodiments of such ribbons are similar to the ribbons in said U.S. patents and involve a backing layer extending across the full width of the ribbon to prevent the printing portion from being contacted directly by type face. Further, such prior art ribbons are characterized by the correction portion of the ribbon being of greater thickness than the printing portion.

Composite ribbons of the type having a backing extending across the full width of the ribbon and wherein the correction portion is thicker than the remainder of the ribbon have an objection to their use in certain circumstances. Thus, recent design changes in some typewriters precludes use of such ribbons due to the fact that they are too thick and cannot pass through the guides of the typewriters. The ribbon of the present invention is structurally interrelated in a manner so that the ribbon may be used on any typewriter while at the same time will enable a longer length of the ribbon to be wound on a standard spool than was possible with the ribbons disclosed in the prior art such as the ribbon in U.S. Pat. No. 3,273,686.

The printing ribbon of the present invention includes a longitudinally extending printing portion of inked fabric and a longitudinally extending correction portion joined thereto. Each portion is about the same width, and constitutes approximately one half the width of the ribbon. The printing ribbon is comprised of a single thickness of fabric which is the thickest portion of the ribbon and has a thickness of not more than 0.0035 inches.

The correction portion of the ribbon includes a backing which carries a layer of correction material thereon. The width of the layer of correction material is narrower than the width of the backing. The side edges of the correction material are parallel to but spaced inwardly from the side edges of the backing. One side edge of the backing is welded to a side edge of the printing portion of the ribbon.

The correcting portion of the ribbon lies in the same plane as the printing portion and preferably is slightly thinner than the printing portion of the ribbon. The side edge of the correction material adjacent the center of the ribbon is spaced from the adjacent side edge of the printing portion by a gap. The other side edge of the correction material is spaced from the adjacent edge of the backing by a gap.

It is an object of the present invention to provide a printing ribbon for a machine such as a typewriter and which is capable of being utilized in all makes of typewriters.

It is another object of the present invention to provide a printing ribbon having a printing portion and a correction portion wherein the printing portion is a single thickness of fabric having a thickness greater than the thickness of the correction portion and less than about 0.0035 inches.

It is another object of the present invention to provide a printing ribbon having a printing portion and a correction portion constructed in a manner so as to enable larger amounts of the ribbon to be wound on a conventional spool.

It is another object of the present invention to provide a printing ribbon having a printing portion spaced from a correction material by a gap to preclude bleeding of ink into the correction material.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
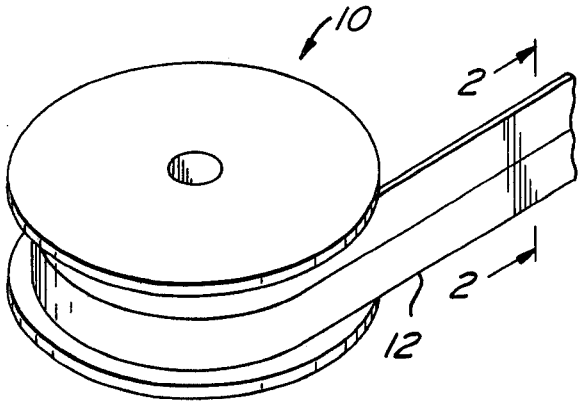
FIG. 1 is a perspective view of a spool having a ribbon in accordance with the present invention wound thereon.

Referring to the drawing in detail, wherein like numerals indicate like elements, there is shown in FIG. 1 a spool 10 of conventional construction having a ribbon 12 of the present invention wound thereon.

Figure 2:
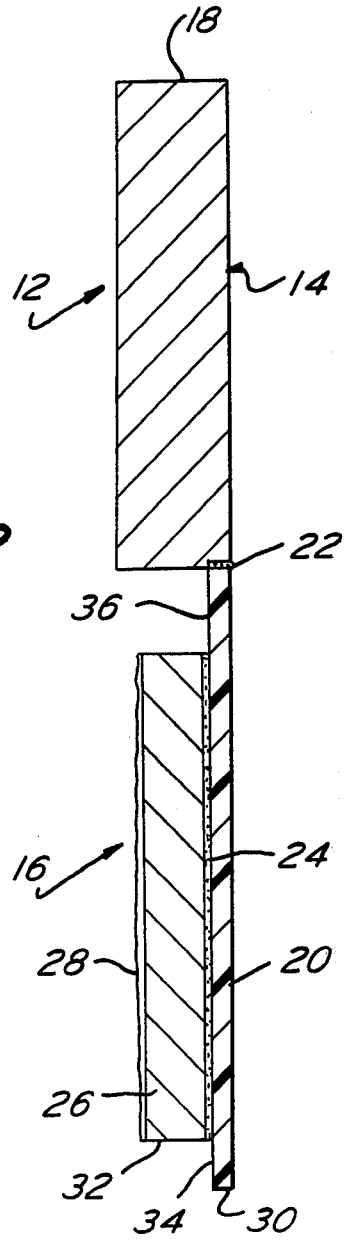
FIG. 2 is a sectional view taken along the line 2—2 in FIG. 1 but on an enlarged scale.

Referring to FIG. 2, the ribbon 12 includes a printing portion 14 and a correction portion 16 each of approximately the same width and extending longitudinally along the length of the ribbon 12. The printing portion 14 is the thickest portion of the ribbon 12 and preferably is a single thickness of inked nylon fabric 18 having a thickness of not more than about 0.0035 inches so that the ribbon 12 may fit through the guides on all presently known typewriters.

The correction portion 16 of the ribbon 12 includes a backing 20 which is preferably in the form of a transparent or translucent polymeric plastic film such as nylon film. One side edge of backing 20 is joined with a butt weld 22 to one side edge of the layer of fabric 18. As illustrated in FIG. 2, a portion of the plastic material of backing 20 melts into the interstices of a portion of the side edge of the layer of fabric 18 adjacent one corner thereof.

The correction portion 16 includes correction material 28 on a carrier such as paper layer 26 bonded or otherwise secured to the backing 20 in any convenient manner such as by the layer of adhesive 24. Layer of adhesive 24 need not be a discrete layer but instead securement may be attained by a heat sealing effect. It will be noted that the width of layer of correction material 28 is narrower than the width of backing 20. One side edge 32 of the paper layer 26 is spaced from the adjacent side edge 30 of the backing 20 to define a gap 34. The portion of backing 20 which corresponds to the width of the gap 34 acts as a spacer rail and rides on the typewriter guides so as to prevent the lower (left hand in FIG. 2) edge from riding directly on the guides which is objectionable since it scrapes off the correction material 28. The edge of paper layer 26 opposite edge 24 is spaced from the adjacent edge of the layer of fabric 18 by a gap 36. Gap 36 prevents ink from the printing portion 14 bleeding onto the correction material 28.

The correction material 28 is a white colored camouflage medium which may be supported by the paper layer 26 or may be supported directly by the backing 20. A variety of different compositions may be used for the correction material 28 whereby it will camouflage a printed digit or letter with a white powder-like material.

By way of illustration and not by way of limitation, a preferred construction for the ribbon 12 is as follows. The layer of fabric 18 constituting the printing portion 14 is a single thickness of sheer, inked nylon fabric having a thickness of 0.0033 inches and a width of 5.7 millimeters. The backing 20 is a layer of transparent nylon film having a thickness of about 0.0005 inches and a width of 7.3 millimeters. The paper layer 26 with the correction material 28 thereon has a thickness of 0.002 inches and a width of 5.7 millimeters. Gap 34 has a width of about one half millimeter while gap 36 has a width of about 1 millimeter. Weld 22 has a width of about ¼ millimeter. The entire ribbon 12 has a width of 13 millimeters.

Backing 20 may be comprised of other polymeric plastic materials. The layer of fabric 18 may be made from other materials such as Dacron (trademark). The paper layer 26 is preferably adhesively bonded across its full width and length to the backing 20 so as to prevent puckering when struck by a typewriter key. A ribbon 12 constructed as set forth above will enable about 15 yards to be wound on a conventional spool as compared with about 7 yards of ribbon constructed in accordance with said U.S. Pat. No. 3,273,686.

The layer of fabric 18 is preferably woven with crimped yarn and lightly inked in accordance with commercially accepted practices wherein the ink has a dry appearance. The particular details of the ink as well as the particular details of the correction material 28 are commercially known to those skilled in the art, and per se, form no part of the present invention.

The present invention may be embodied in other specific forms without departing from the spirit or essential attributes thereof and, accordingly, reference should be made to the appended claims, rather than to the foregoing specification as indicating the scope of the invention.

I claim:

1. A printing ribbon comprising a longitudinally extending printing portion and a longitudinally extending correction portion joined thereto, said printing portion being the thickest portion of said ribbon and having a thickness not more than about 0.0035 inches, said printing portion being only a single thickness of inked fabric without any backing, said correction portion including a backing carrying thereon a layer of correction material whose width is narrower than the width of the backing, one side edge of said backing being connected with a butt weld directly to one side edge of said printing portion longitudinally along the ribbon, said weld being the only means interconnecting said printing and correction portions, side edges of the layer of correction material being generally parallel to and spaced from said one side edge of said backing, said correction portion lying between the planes defined by the side faces of said printing portion, and a side edge of said layer of correction material being spaced by said backing from said one side edge of the printing portion by a gap extending longitudinally down the middle of the ribbon to prevent ink from the printing portion bleeding into the correction material.

2. A ribbon in accordance with claim 1 wherein said correction portion is wider than said printing portion by about 1–1.5 millimeters, the width of said layer of correction material being substantially equal to the width of said printing portion.

3. A ribbon in accordance with claim 1 wherein the side edge of said layer of correction material remote from said one edge of said printing portion is spaced from the adjacent side edge of said backing by a distance of approximately ½ millimeter.

4. A ribbon in accordance with claim 1 wherein said layer of correction material is supported by a paper layer adhesively bonded across its full width and length to said backing, said backing being a polymeric plastic.

5. A ribbon in accordance with claim 4 wherein said polymeric plastic backing is transparent.

6. A ribbon in accordance with claim 1 wherein the side edge of said layer of correction material remote from said one edge of said printing portion is spaced from the other side edge of said backing by a distance of approximately ½ millimeter, said correction material being supported by a paper layer bonded across its full width and length to said backing.

* * * * *